United States Patent [19]

Baustin

[11] Patent Number: 4,847,618

[45] Date of Patent: Jul. 11, 1989

[54] VEHICULAR TRAFFIC CONTROL SYSTEM

[76] Inventor: Estelle Baustin, 1066 E. 81st St., Brooklyn, N.Y. 11236

[21] Appl. No.: 944,922

[22] Filed: Dec. 22, 1986

[51] Int. Cl.[4] ..... G08G 1/096

[52] U.S. Cl. ..... 340/929; 116/63 R; 340/916; 340/932

[58] Field of Search ..... 340/907, 916, 928, 929, 340/932, 926; 116/63 R, 63 P

[56] References Cited

U.S. PATENT DOCUMENTS

| | | | |
|---|---|---|---|
| 2,007,801 | 7/1935 | Halvorson | 340/932 |
| 2,407,432 | 9/1946 | Manewich | 340/932 |
| 2,604,525 | 7/1952 | Zannettos | 340/929 |
| 2,683,868 | 7/1954 | McKnight | 340/932 |
| 2,768,365 | 10/1956 | Jones | 340/932 |
| 3,320,585 | 5/1967 | Hines | 340/929 |
| 3,529,287 | 9/1970 | Southerland | 340/929 |
| 4,200,860 | 4/1980 | Fritzinger | 340/929 |
| 4,371,863 | 2/1983 | Fritzinger | 340/929 |
| 4,590,455 | 5/1986 | Fritzinger | 340/916 |

*Primary Examiner*—Joseph A. Orsino
*Assistant Examiner*—Brent A. Swarthout
*Attorney, Agent, or Firm*—William P. Keegan

[57] ABSTRACT

A traffic control system for controlling vehicular traffic flow at intersections in which the conventional red, yellow, green three light traffic signal that informs a motorist to stop, prepare to stop, and go is supplemented by an auxiliary signal spaced from the intersection. The auxiliary signal informs a motorist that he will have sufficient time to make a gradual normal stop at the intersection before the red stop light is switched on, provided he has not passed the auxiliary signal when the yellow light of the traffic signal is illuminated. If he has passed the auxiliary signal when the yellow light of the traffic signal is switched on, he will know that he can proceed through the intersection before the red stop light is switched on. The auxiliary signal may be a single or double yellow light operating in synchronism with the yellow light of the traffic signal, or it may be another type of signal, such as a painted zone on the roadway surface.

3 Claims, 1 Drawing Sheet

VEHICULAR TRAFFIC CONTROL SYSTEM

FIELD OF THE INVENTION

This invention relates to vehicular traffic control systems, and more particularly to a traffic control system employing a traffic control signal comprising, for each direction of traffic flow, a red "STOP" signal, a green "GO" signal, and a yellow or amber "WARNING" signal that indicates that the red signal is about to be actuated.

Traffic control systems for regulating automotive traffic flow at street or highway intersections are well known. For example, a three light system of the type just mentioned is widely used for controlling traffic flow. The yellow signal is used to indicate to or warn the oncoming motorist that the red signal will soon be actuated and that the motorist approaching the intersection should be prepared to stop at the intersection. The yellow signal ordinarily is not actuated when the signal changes from red to green, or in other words, when the halted traffic is signalled to proceed through the intersection.

While a traffic control system operating as indicated generally is satisfactory, it is not without shortcomings, particularly in that certain problems confront a motorist when the yellow signal is illuminated. In New York State, for example, it is permissible for a motorist to drive into and through an intersection when the traffic signal light is green or yellow; the motorist is not permitted to enter the intersection when the traffic signal light is red. Thus, when the yellow signal is actuated as a motorist approaches an intersection, the motorist may be in a position, i.e., the vehicle will be at some distance from the intersection and travelling at a speed within the limits established for that street or highway, where there is uncertainty in the motorist's mind as to whether or not the vehicle can proceed at its travelling speed and enter the intersection while the yellow signal is illuminated and before the red signal is actuated. On the other hand, the motorist has to make a judgmental decision based upon his driving experience as to whether or not the vehicle can be brought to a normal stop at the crosswalk and not in the intersection, or that is not abrupt or sudden since such a stop might give rise to a rear end collision from a following vehicle that is not prepared to stop suddenly.

In traffic control systems employing a yellow signal, the duration that the signal is illuminated before the red signal is switched on generally will depend on the speed limit prescribed for the street or highway. The higher the speed limit the longer the yellow signal will be illuminated. In this way a motorist travelling at a higher speed as permitted on a highway will be able to proceed through the intersection before the red signal is switched on. But, even on roads or highways with a uniform speed limit, the duration of the yellow warning signal may vary between different traffic signals. In either case the motorist does not know how long the yellow signal will be illuminated and he may be uncertain if the vehicle could be brought to a safe normal stop before the red signal is switched on. The motorist might even bring his vehicle to a stop at the intersection before the red signal is switched on, and this could lead to accidents because following motorists might not expect the vehicle to be brought to a halt.

In the prior art attention has been directed to the problems presented by the uncertainty as to when the red signal is going to be actuated or switched on even though the yellow signal indicates that such occurrence will be imminent. Thus, U.S. Pat. No. 3,529,287 discloses an amber 'WARNING' signal comprising a series of timer controlled light segments that are serially illuminated to give an oncoming motorist an indication of the time remaining before the red signal will be switched on. For example, if half of the light segments, arranged as a halo around the green signal, are illuminated, the motorist is thus informed that half of the green signal period is over, and when all of the amber light segments are illuminated that the red signal will be switched on. However, the motorist would generally be unaware of the time periods that the amber light segments are illuminated, and even if he was, there would be no way of knowing whether or not the vehicle could safely enter the intersection or, alternatively, be brought to a normal stop without entering the intersection before the red signal is switched on. U.S. Pat. No. 2,480,290 similarly discloses an auxiliary signaling means that progressively changes to give notification of the time remaining before the green signal is extinguished and the red signal is illuminated. Again, an oncoming motorist is simply informed that switching on of the red signal is imminent. The signaling means, in both patents, does nothing to indicate to a motorist that it is safe to proceed into the intersection because he can do so before the red signal is switched on or that he will be able to bring the vehicle normally and gradually to a stop at the intersection. General Description of the Invention The present invention is intended to overcome the shortcomings of the prior art by providing a traffic control system that indicates to a motorist proceeding along a highway or street under control of a green signal that when the yellow signal is illuminated to indicate an imminent illumination of the red signal that he will be able to safely proceed into the intersection before the red signal is illuminated, or that he will be able to bring the vehicle to a safe gradual stop at the intersection.

The object of the invention is to provide an improved traffic control system.

Another object of the invention is to provide an improved system for controlling traffic flow at intersections.

Still another object of the invention is to provide a traffic control system that will minimize accidents at intersections between a vehicle proceeding along the highway or street and traffic, pedestrian or vehicular, crossing the highway or street.

Yet another object of the invention is to enable a motorist to better comply with the traffic laws.

Another object of the invention is to provide a traffic signal system that enables a motorist to judge whether or not to proceed through an intersection when the yellow signal is illuminated to indicate that the red signal shortly will be illuminated.

In carrying out the invention, a zone or boundary indication is provided before the signal controlled intersection which indicates to the motorist that if the yellow signal of the traffic signal is illuminated while he is in the zone or before he reaches the boundary he should prepare to stop since the red stop signal will be illuminated before he reaches the intersection. The boundary indicator may preferably take the form of an auxiliary yellow "WARNING" signal operating in synchronism with the yellow signal of the conventional three light traffic control signal provided at a predetermined position ahead of the intersection controlled by the traffic control signal. The distance that the auxiliary yellow signal is placed ahead of the intersection will depend on the speed limit prescribed for the highway or street. The higher the speed limit the greater the distance the auxiliary yellow signal will be spaced from the intersection. The distance will depend on the distance that it takes to stop a vehicle travelling at the speed limit. These distances are generally known to highway engineers and take into account average driver response time to a changing traffic signal and normal braking or stopping distances for vehicles travelling at different speeds. If the motorist travelling at the speed limit is past the auxiliary yellow signal, i.e., between the auxiliary signal and the traffic signal at the intersection, when the yellow signal is switched on (at both the traffic signal and the auxiliary signal), he will know that he can proceed through the intersection before the red signal is switched on at the intersection. On the other hand, if the yellow signal is illuminated before the motorist reaches the auxiliary signal, he will know that the red signal will be switched on at the intersection before he reaches the intersection and that he will be able to bring the vehicle to a safe gradual stop at the intersection. Another version of the invention would be a yellow zone or a yellow boundary line painted on the roadway surface; it may be a zone adjacent the intersection or it may be a zone or boundary line spaced therefrom. In the former case, the motorist will proceed through the intersection if he is in the zone when the yellow signal 17 is illuminated. In the latter case, he will prepare to stop if he is in the zone, or not past the boundary line, when signal 17 is illuminated.

Features and advantages of the invention may be gained from the foregoing and from the description of the preferred embodiment thereof which follows.

Figure 1:
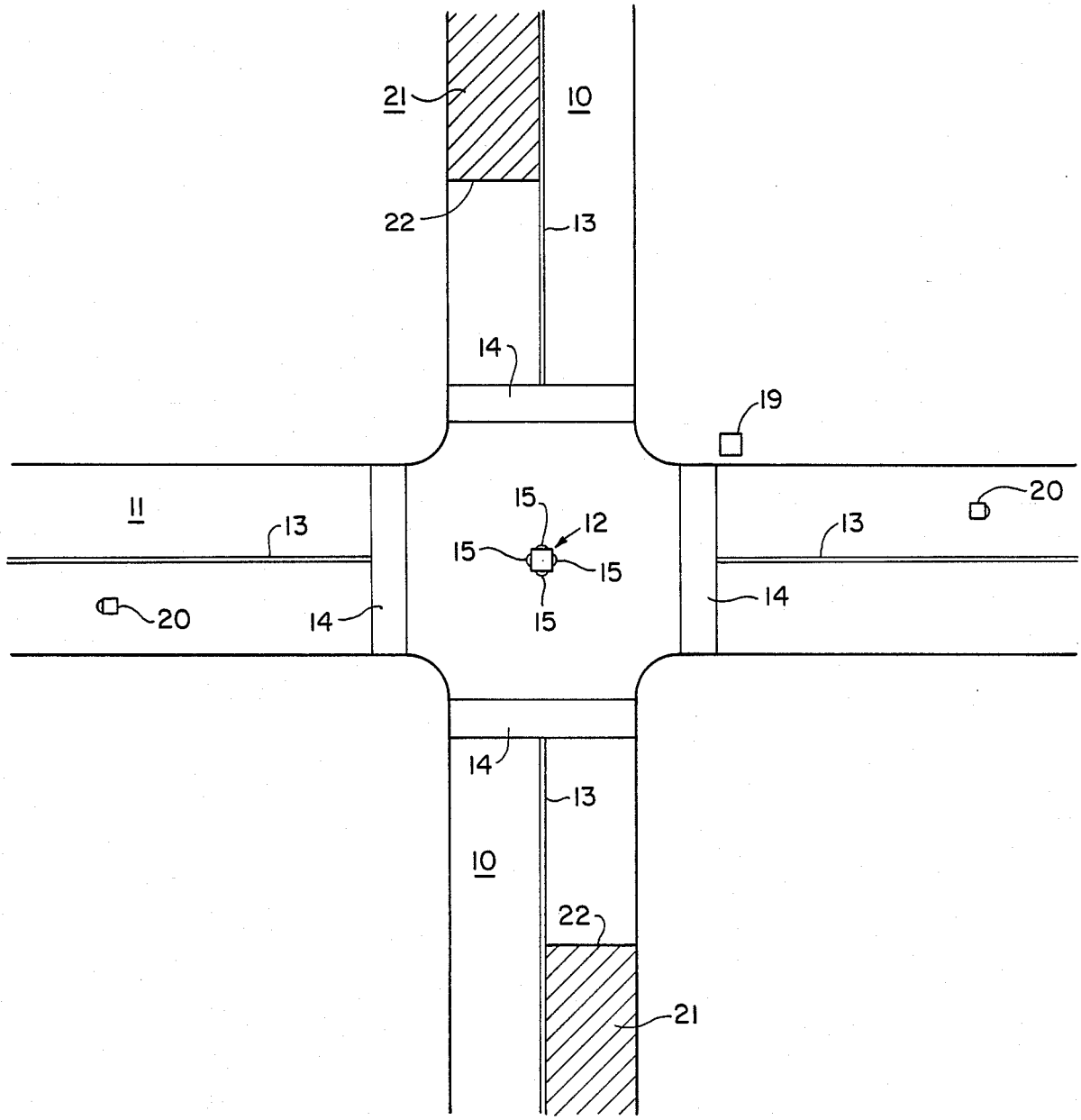
FIG. 1 is a schematic plan illustration of a highway or street intersection controlled by a control system according to the present invention.
Figure 2:
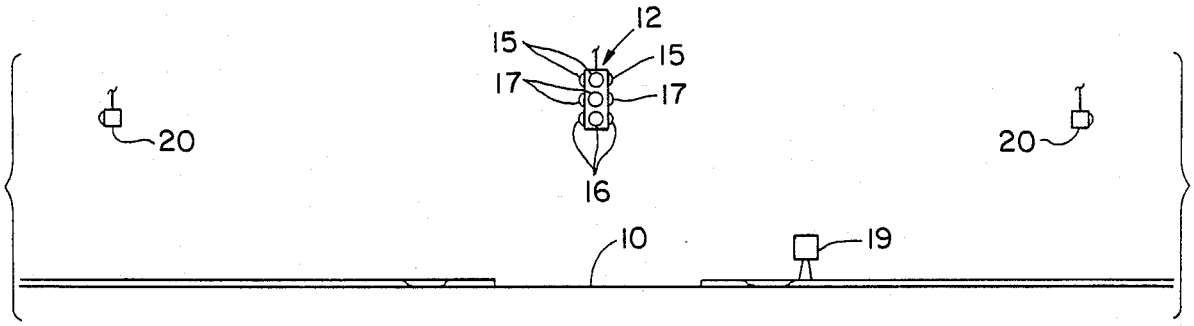
FIG. 2 is a schematic elevational illustration of the same intersection.

Referring to the drawing, a road or street 10 is intersected by a cross street 11 and vehicular traffic along both streets is controlled by a traffic signal 12. Each street is shown as carrying two-way traffic, so a center line 13 is provided for separating or dividing the traffic flowing in opposite directions. If there is much pedestrian traffic along the streets cross walks 14 are usually demarcated to indicate the safe cross areas for pedestrians to cross the streets. Otherwise, a simple stop line may be provided to indicate to motorists the stopping position for vehicles stopped by the traffic signal 12.

Traffic signal 12 generally is the well known "traffic light" in which three signal lights face each direction of oncoming vehicular traffic. Thus, a red "STOP" signal 15 will be located above a green "GO" signal 16 with a yellow or amber "WARNING" signal 17 located between the two. The significance or means of these signals are well known and will not be described here other than to state that yellow signal 17 will be illuminated when green signal 16 is turned off to indicate to an oncoming motorist that red signal 15 will soon be switched on. When red signal 15 is switched on, yellow signal 17 is switched off. Generally, the yellow signal is not actuated when the signal sequence is from the red signal to the green signal. Sequencing and timing of signal operations may be controlled in a well known manner from a control unit 19 located near the intersection when the intersection controlled is relatively isolated or, in an urban situation having a series of traffic signal controlled intersections, the control unit may be a centralized computer system that also synchronizes the operation of a series of traffic signals to maintain a steady traffic flow at the prescribed speed limit.

As mentioned in the background information, traffic control signals of the type described are widely used, and in general have been quite satisfactory. However, they do provide motorists with information that at times leaves the motorist uncertain as to how to approach the intersection being controlled by a traffic control signal. Thus, when the yellow signal 17 is illuminated, should the motorist proceed at normal speed with the expectation that he will enter the intersection before the red signal 15 is switched on, or should he attempt to stop at the intersection in anticipation of red signal 15 being switched on before he reaches the intersection, if indeed he is able to bring the vehicle to a safe gradual stop at the stop line or cross walk 14. The motorist will depend on his driving experience to judge which course to pursue. However, he will not know exactly the time it will take before red signal 15 is switched on, although he does know that this will occur imminently. Nor does he know if he can bring the vehicle to a safe gradual stop at the intersection from the position the vehicle is in at the time the yellow signal is first switched on.

Federal Motor Vehicle Safety Standard No. 105-75 requires that new passenger cars with hydraulic service brakes be capable of stopping in 84.0 feet from a speed of 30 MPH, in 105.5 feet from 35 MPH, in 131.0 feet from 40 MPH, in 159.5 feet from 45 MPH, in 190.0 feet from 50 MPH, in 223.5 feet from 55 MPH, and in 260.0 feet from 60 MPH. The test conditions specify a lightly loaded vehicle, tire inflation pressure as recommended by the vehicle manufacturer, level roadway, no wind velocity, and other technical provisions. Average driver reaction time has been taken into account and the distance a vehicle travels in this time has been added to the braking requirements for vehicles to give the total stopping distances set forth above. Other factors such as smooth tires, wet road conditions, will extend the stopping distances.

In order to provide a motorist with additional information that will enable him, when confronted with a yellow "WARNING" signal, to make a proper decision whether to proceed through the intersection controlled by the traffic signal or to bring the vehicle to a smooth gradual stop, it is proposed that an auxiliary yellow signal 20, working in synchronism with yellow signal 17 in traffic control signal 12 be provided some distance "D" spaced ahead of the stop line at the intersection. The distance "D" will, in general, be no less than the stopping distance that it takes a vehicle travelling at the speed limit for the street or highway to be brought to a stop as set forth in the Federal standard. The distance may be extended to provide a margin of safety, and to make allowance for other factors or for older vehicles that may not meet the Federal standards.

Thus, on a street on which the speed limit is 30 MPH, auxiliary yellow signal 20 will be spaced 84.0 feet from the stop line at the intersection. Where the speed limit is 60 MPH, auxiliary signal 20 will be spaced 260.0 feet from the intersection stop line. In this way a motorist driving along the street at the speed limit will know that if he has not passed auxiliary yellow signal 20 before it is switched on, he will be able to bring the vehicle to a safe gradual stop at the intersection. On the other hand, if the yellow "WARNING" signal 17 (on traffic signal 12) and auxiliary signal 20 are not switched on until after he passes auxiliary signal 20, the motorist will know that he cannot bring his vehicle to a smooth gradual stop at the intersection and that he should proceed through the intersection. To insure that he can do this before red signal 15 is switched on, the timing period for the yellow signal must be long enough for the motorist to travel at the speed limit from auxiliary signal 20 through the intersection. For example, if the speed limit is 30 MPH the duration of the yellow signal will be a minimum of 1.91 seconds, the time for a vehicle to travel 84 feet at 30 MPH. For other speed limits the minimum duration of the yellow signal will be as follows: for 35 MPH, 2.06 seconds; for 40 MPH, 2.23 seconds; for 45 MPH, 2.42 seconds; for 50 MPH, 2.59 seconds; for 55 MPH, 2.77 seconds; and for 60 MPH, 2.95 seconds. The times given can be increased to provide a margin of safety to assure that if the yellow signal is switched on as the motorist is passing auxiliary signal 20, he will be able to drive into or through the intersection before red signal 15 is switched on, even if he is travelling at a speed slightly below the speed limit.

The following table summarizes the minimum distance "D" in feet that the auxiliary signal 20 will be spaced from the intersection for various speed limits in MPH and the minimum time "T" in seconds that the yellow signal will be illuminated before the red signal is switched on.

TABLE I

| MPH | "D" | "T" |
|---|---|---|
| 30 | 84.0 | 1.91 |
| 35 | 105.5 | 2.06 |
| 40 | 131.0 | 2.23 |
| 45 | 159.5 | 2.42 |
| 50 | 190.0 | 2.59 |
| 55 | 223.5 | 2.77 |
| 60 | 260.0 | 2.95 |

In operation, auxiliary signal 20 will operate in synchronism with yellow "WARNING" signal 17 of traffic control signal 12, because auxiliary signal 20 will be located ahead of intersection 11 by a distance, at least, equal to the distance "D" set forth in Table I and will be illuminated for a time period at least equal to the time "T" also set forth in Table I, both as determined by the speed limit prescribed for the thoroughfare, a motorist approaching the intersection and still not past auxiliary signal 20 when that signal and yellow signal 17 are simultaneously switched on will know that the red signal 15 will be switched on before he reaches the intersection and that he will have a sufficient distance in which to bring the vehicle to a smooth gradual stop at the intersection. If the motorist is past auxiliary signal 20 when it and yellow signal 17 are switched on he will know that, assuming he is travelling at the speed limit, he will be able to proceed into the intersection before red signal 15 is switched on.

The distances "D" and the time periods "T" set forth in Table I may be extended to provide a margin of safety.

It should be clear from the foregoing that the location of auxiliary signal 20 defines a boundary or position at which a decision is made by a motorist depending on whether or not the auxiliary signal 20, and the "WARNING" signal 17 since the two operate in synchronism, is illuminated. If the signals are illuminated before the motorist passes signal 20 he should be prepared to stop at the intersection controlled by traffic signal 12, and if the signals are not illuminated he should proceed through the intersection.

As an alternative, and in the interest of economy, auxiliary signal 20 may be omitted and the boundary (that would otherwise be indicated by its location) may be indicated by the end of a zone painted on the surface of the roadway. The zone may extend from the boundary towards the intersection or away from the intersection. In the former case, if "WARNING" signal 17 of traffic signal 12 is illuminated before the motorist reaches the painted zone, he should be prepared to stop. If he is in the zone when signal 17 is illuminated he should proceed through the intersection. In the latter case, e.g., zone 21 (FIG. 1), if he is in the zone and has not passed through it, (or over it if it is simply a yellow boundary line 22 instead of a full painted zone) when signal 17 is illuminated, he should be prepared to stop at the intersection, If he has passed the boundary line 22 or is out of the zone 21 he should proceed through the intersection. Reflectors embedded in the road surface may be provided to enhance visibility of zone 21 or boundary line 22 during hours of darkness.

Having thus described the invention, it is to be understood that many modifications and changes may be made to the preferred embodiment disclosed without departing from the spirit and scope of the invention. For example, the traffic control signal 12 may be a two light signal comprising a red signal and a green signal in which the green signal remains illuminated for a period of time after the red signal is switched on. The period in which both signals are simultaneously illuminated corresponds to the period of illumination of the yellow signal in a three light traffic control signal and had the same significance as the yellow signal, namely, that the red signal will imminently be the only signal illuminated to indicate that the motorist should stop at the intersection. The auxiliary signal 20, when used in conjunction with a two light traffic control signal, may still be a yellow light. Also, additional signals, tactile or visual, may be provided ahead of auxiliary signal 20, i.e., farther away from the intersection being controlled by traffic control signal 12, to alert the motorist that he is approaching auxiliary signal 20, but signal 20 will still be the only guide the motorist uses to determine whether or not he will be able to effect a normal stop at the intersection. Such additional signals may be a flashing light along the side of the roadway, or stripes painted on the surface of the roadway, or grooves cut into the surface of the roadway. Therefore, it is intended that the foregoing specification and the drawing be interpreted in an illustrative rather than in a limiting sense.

What is claimed is:

1. A system for controlling vehicular traffic flow at a roadway intersection comprising: a traffic signal located at the intersection having, for each direction of traffic flow, signal means to stop traffic at the intersection, signal means to permit traffic to go through the intersection, and signal means for warning vehicular traffic that the stop signal means is soon to be actuated; means for sequentially cycling said go, warning, and stop signal means; indicating means comprising an auxiliary warning signal operating in synchronism with said traffic signal warning signal means, said indicating means being spaced from the intersection controlled by said warning signal means a distance substantially equal to the distance within which a vehicle travelling at the speed limit prescribed for the roadway can safely be brought to a stop at the intersection; and means for operating the warning signal means controlling at least one direction of traffic flow for a period of time that will enable a vehicle just passing said indicating means while travelling along the roadway at the speed limit prescribed for the roadway to continue at the speed limit so as to proceed through the intersection before said stop signal means is operated; the relationship between said indicating means and said warning signal means being such that a motorist driving at the speed limit will know that if said warning signal means is operating before he reaches said indicating means he should prepare to stop at the intersection, but that if he has passed said indicating means before said warning signal means is operated he should proceed through the intersection.

2. A traffic control system according to claim 1 wherein said auxiliary signal comprises a yellow traffic light.

3. A system for controlling vehicular traffic flow at a roadway intersection comprising: a traffic signal located at the intersection having a red stop light which when operated indicates that traffic is to stop at the intersection, a green go light which when operated indicates that traffic is to go through the intersection, and a yellow warning light which when operated indicates that the red light is soon to be operated; auxiliary means comprising an auxiliary yellow warning light operating in synchronism with said traffic signal yellow warning light, said auxiliary means being located along the roadway at a distance from the intersection substantially equal to the distance within which a vehicle travelling at the speed limit prescribed for the roadway can safely be brought to a stop at the intersection; and means for operating said yellow warning light for a period of time that will enable a vehicle just passing said auxiliary means while travelling at the speed limit prescribed for the roadway to continue at that speed limit so as to proceed through the intersection before said red stop light is operated, the relationship between said auxiliary warning light and said warning light being such to inform a motorist travelling at the speed limit that if said yellow warning light is operated before he reaches said auxiliary means he will be able to stop his vehicle at the intersection before said red stop light is operated.

* * * * *